US005109325A

United States Patent [19]

Bayer et al.

[11] Patent Number: 5,109,325

[45] Date of Patent: Apr. 28, 1992

[54] FASTENING DEVICE FOR CHANDELIER TRIMMINGS

[75] Inventors: Georg Bayer; Arnold Schonbek, both of Plattsburgh, N.Y.

[73] Assignee: A. Schonbek & Co., Inc., Plattsburgh, N.Y.

[21] Appl. No.: 632,414

[22] Filed: Dec. 21, 1990

Related U.S. Application Data

[63] Continuation of Ser. No. 138,851, Dec. 29, 1987, abandoned.

[51] Int. Cl.[5] ..... F21S 1/04

[52] U.S. Cl. ..... 362/433; 362/339; 362/457

[58] Field of Search ..... 362/457, 433, 806, 404, 362/405, 406, 396, 339; D8/367, 370; 248/340, 303, 304, 322, 339, 341; D26/84, 87, 91, 92, 154, 138, 142, 145, 113; 428/7; 24/546, 369

[56] References Cited

U.S. PATENT DOCUMENTS

| | | | |
|---|---|---|---|
| Re. 10,008 | 1/1882 | Jacobsen | 362/405 |
| D. 16,550 | 2/1886 | Schneider | D26/154 |
| 178,941 | 6/1876 | McLewee | 362/339 |
| 180,800 | 8/1876 | Shirley | 362/339 |
| D. 209,703 | 12/1967 | Loch | D26/138 |
| D. 248,790 | 8/1978 | Castor | D26/138 |
| 1,172,937 | 2/1916 | Butcher | D8/370 |
| 2,513,565 | 7/1950 | Johnson | 362/339 |
| 2,980,920 | 4/1961 | Lieberman | 248/324 |

FOREIGN PATENT DOCUMENTS

| | | | |
|---|---|---|---|
| 1293964 | 4/1962 | France | 362/806 |
| 155955 | 1/1921 | United Kingdom | 362/806 |

*Primary Examiner*—Ira S. Lazarus
*Assistant Examiner*—Richard R. Cole

[57] ABSTRACT

The invention relates to a chandelier including chandelier trimmings connected to a framework by way of a hook and an attachment whereby the attachment is integral with at least part of the framework. The attachment consists of two openings which may be two slots or a slot and a hole which are located in the framework in such a way that the hook can be introduced into the attachment with the minimum of rotational movement and in such a way that the chandelier can be constructed even in close to the ceiling arrangement. It is advantageous if the framework is made from a flat strip or a plate. The hook is formed from wire and consists of a series of bends provided in such a way that when the hook is located in the attachment the trimmings achieve their correct position such that the framework is hidden by the trimmings. In this way, the framework need not be made of an ornamental material. The hook is provided with a stop at its end in the form of a head or a bend such that when the hook is in its final position it cannot be separated from the framework in a horizontal outward or vertical downward motion.

35 Claims, 12 Drawing Sheets

FASTENING DEVICE FOR CHANDELIER TRIMMINGS

This application is a continuation of application Ser. No. 07/138,851, filed Dec. 29, 1987 now abandoned.

The invention relates to fastening devices for chandelier trimmings. The chandelier comprises chandelier trimmings with a hook means and a framework for carrying said hook means by an attachment means so that the trimmings are positioned and fastened correctly.

The traditional form of chandelier consists of a plurality of chandelier trimmings hanging from an ornamental framework. In such an arrangement the framework of the chandelier is visible and therefore of ornamental value. Further, the chandelier trimmings hang, essentially perpendicular as determined by gravity alone and therefore there is a limit to the designs which can be constructed.

Figure 1A:
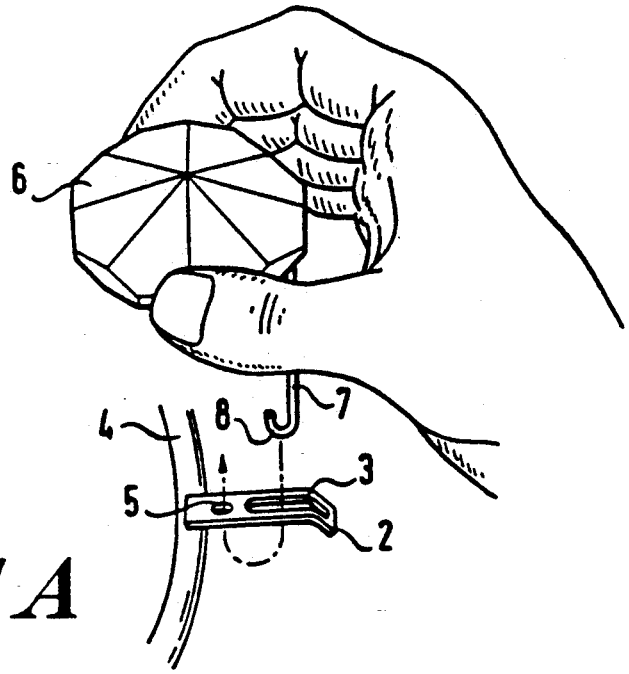
Figure 1B:
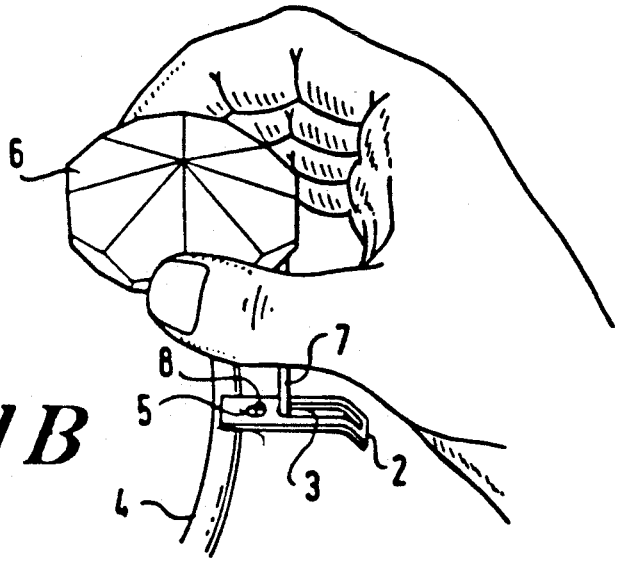
Figure 1C:
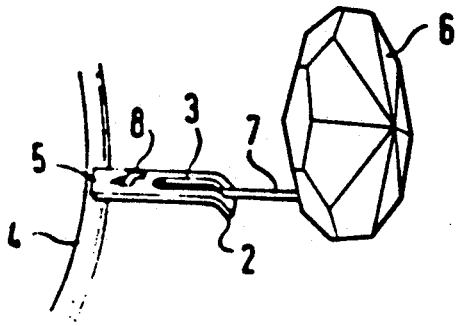

In order to eliminate the disadvantages of the conventional system a chandelier trimming has been designed as shown in FIGS. 1*a*–1*c*. The chandelier trimming in form of a jewel or any other shape (6) is permanently connected to a hook (7). The framework (4) of the chandelier has a bracket (2) attached to it. The chandelier trimming is installed in the following way. The trimming (6) is held so that the base (8) of the hook (7) is above the slot (3) in the bracket (2). The fitting is then lowered so that the hook enters the slot, is pushed towards the centre of the fixture and then raised so that the end of the hook (8) enters the hole (5). With the hook in the bracket as shown the trimming is pivoted downwards so that the hook rests in the end of the slot. By bending the shank of the hook alternatively by setting the bracket at various angles, it is possible to adjust the position of the trimming in any desired way. Further, it is possible to glue the wire hooks into the brackets which allows designs of a very complex nature including those in which the hook and trimming lie vertically upwards from the framework. Further, the trimming conceals the framework so that the hooks and the framework are not of ornamental value. This advanced design has several disadvantages. The operations of attaching and removing the trimmings are both complicated and costly, further, chandeliers which have to be hung close to the ceiling can not be installed since there is no space for the circular motion required in the process of attaching and removing trimmings. Further, the manufacture of such chandelier frames is expensive.

The object of the present invention is to construct a chandelier which does not have the disadvantages of the conventional designs.

A further object of the invention is to produce a chandelier in which the trimmings can be easily attached and removed from the framework, either during installation or during cleaning.

A further object of the present invention is to produce a chandelier which can be installed close to the ceiling by using a hook means which can be installed without a circular motion.

A further object of the present invention is to produce a chandelier frame of low cost.

The objects of the invention are solved for a chandelier of the aforementioned type by arranging the attachment means to be integrally constructed from a part of the framework.

The particular advantage of this arrangement is that there is no requirement for attaching the special brackets used to hold the trimmings. Instead the attachment means is directly machined into the framework. Particularly when the framework is made from a flat strip or plate this manufacturing step may be carried out automatically using numerically controlled equipment. The manufacturing costs can be considerably reduced as there are no welding or soldering operations of the brackets to be carried-out. It is, however, still possible to design the attachment means so that when the chandelier trimmings are installed the hook means is concealed and does not have ornamental value, thus maintaining the advantages of the conventional advanced design.

It is particularly advantageous when the attachment means is formed in the framework from two openings and the hook means is formed with at least one bend. In this way the advantages of the advanced constructions shown in FIG. 1 can be maintained.

One form of the present invention provides attachment means with which both said openings are slots aligned on one axis in the framework, each slot being open at the end which is opposite from the other slot and the hook means is formed at its free end with a substantially "U"-shaped bend and is terminated by a stop means larger in diameter than the width of the slot. The said stop means can be provided by a solid head or a loop, or a ring.

With an arrangement of this kind the stop means at the end of the hook rests underneath the framework and is in contact with the slot and prevents the trimming from swinging round to a vertical position. The position of the trimming may be adjusted to any desired location by introducing appropriate bends in the shank of the hook.

A further solution to the present invention is provided when the first opening in the framework is a hole and the second opening is a open slot, the open slot being open at the end opposite to the hole. The use of a hole and slot rather than two slots allows a particularly simple hook form in which the stop means is provided by an end portion of the hook itself.

The hole may be in the form of a round hole or an elongated slot. In this case the hook means can be formed at a free end with a substantially "U"-shaped portion, whereby the free end of the said "U"-shaped portion is further bent in an opposite direction thereto to form an end portion. This end portion can be straight. Further, the "U"-shaped bend can be formed from a double bend with a straight portion therebetween on the side facing the framework part. When located on the framework the inside of the "U"-shaped bend is then flush with the flat surface of the framework part and a particularly stable arrangement is obtained with which the trimming may be positioned very accurately. In this way chandeliers can be constructed in a close-to-the-ceiling situation since the insertion of the hook means requires only a horizontal and short downward motion.

Alternatively, in the case that a flat plate is used as a framework rather than a flat strip the elongated slot may be located well away from the open slot so that in the installed condition the hook of the hook means is located in the slot and the shank of the hook means lies along the framework. In this case a considerable portion of the shank of the hook is supported by the framework and again a particularly stable support of the trimming is obtained. It is advantageous in this form of the present invention to provide a further bend in the shank which locates into the open slot to prevent the trimming from moving sideways. This arrangement also allows close-to-the-ceiling installations.

In the above mentioned arrangements the two openings in the framework lie substantially in one plane, however, the first opening may lie in a plane substantially perpendicular to the plane of the slot. In this case the opening perpendicular to the plane of the slot may be integrally formed from a raised portion of the framework part. The advantage of this arrangement is that the hook means can be very simply manufactured with a single bend and straight portion at its free end. This arrangement also allows close-to-the-ceiling installations.

With all the above mentioned arrangements further bends may be formed in the shank of the hook in order to set the position of the trimming as required. The hook means is normally made of wire, particularly a metal wire. The frame is preferably made from a flat sheet material in the form of a strip or plate.

The invention as well as its embodiments are described in detail in the following in conjunction with the attached drawings in which:

FIGS. 1*a*–1*c* show the installation method of a conventional chandelier fitting.

FIGS. 2*a*–2*g* show the first embodiment of the present invention.

FIGS. 3*a*–3*g* show the second embodiment of the present invention.

FIGS. 4*a*–4*f* show the third embodiment of the present invention.

FIGS. 5*a*–5*g* show the fourth embodiment of the present invention.

FIGS. 6*a*–6*d* show the fifth embodiment of the present invention.

FIGS. 7*a*–7*f* show the sixth embodiment of the present invention.

Figure 2A:
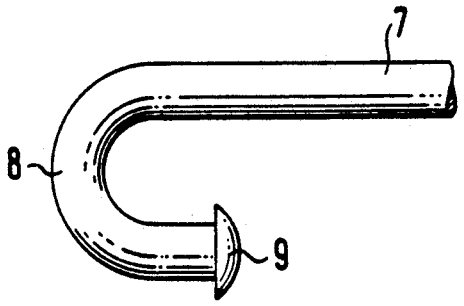

Throughout the figures the same reference numerals are used for the same parts. FIGS. 2*a*–2*g* show a first embodiment of the present invention. In FIG. 2*a* the end of the hook means is shown, consisting of a substantially "U"-shaped bend (8) terminated by an enlarged head portion (9). This head may be formed directly from the wire of the hook or may be a separate part.

Figure 2B:
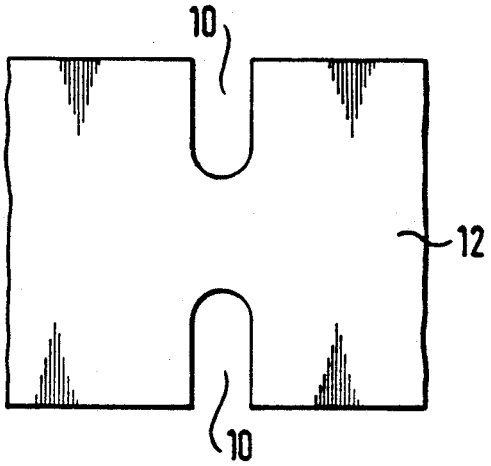
Figure 2C:
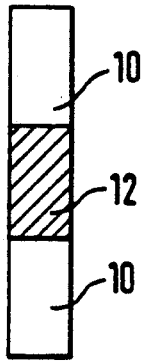

The framework of the chandelier is constructed from a flat strip shown in FIG. 2*b* and 2*c*. Two open slots (10) are provided in the strip, the slots being open at the end away from the opposite slot. The two slots are so arranged that they lie substantially on the same axis. The exact form of the slot may be freely chosen provided the slot width is greater than the diameter of the hook wire and smaller than the head (9) of the hook.

Figure 2D:
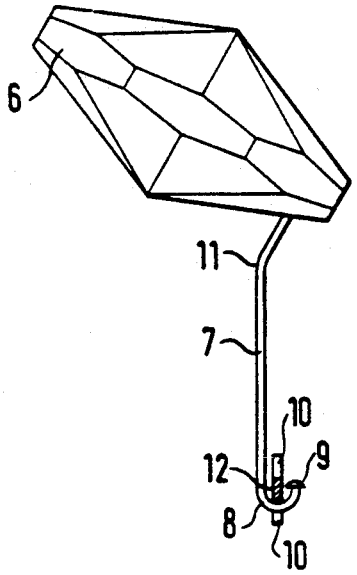
Figure 2E:
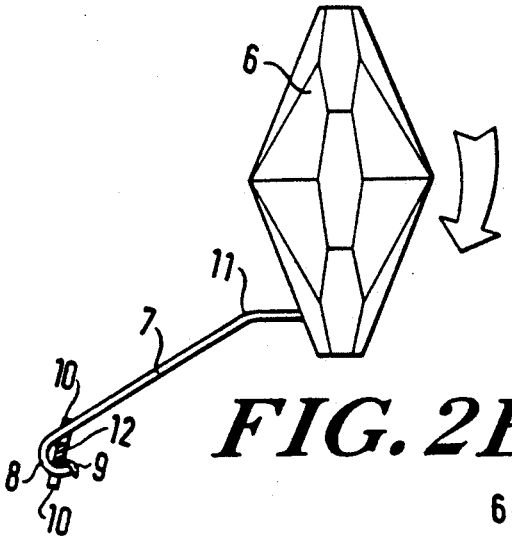
Figure 2F:
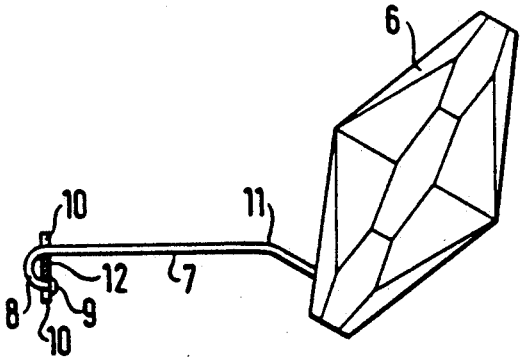
Figure 2G:
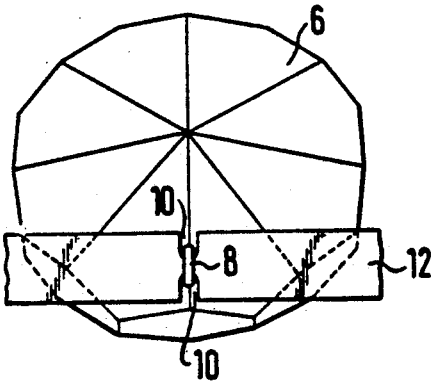

The method of installation of the trimming according to this embodiment of the invention is shown in FIGS. 2*d* to 2*g*. The strip which forms the framework is arranged, for example, in a vertical plane. The trimming (6) is then held in the hand so that the hook (7) is roughly vertical. The "U"-shaped bend (8) and head (9) are then installed in a basically vertical direction as shown in FIG. 2*d* so that the "U"-shaped bend (8) passes through the furthest away slot (10) with the head (9) underneath the strip. The trimming is then rotated until the head contacts the two sides of the slot as shown in FIG. 2*f*. The exact position of the trimming is determined by the length of the "U"-shaped bend (8) and the position of the head (9) as well as the degree of bend of the "U"-shaped bend (8), the length of the hook (7) and the position and degree of bend of supplementary bends such as (11) in the hook (7). As shown in FIG. 2*g* and therefore the strip (12) and the hook (7) are concealed by the trimming (6). The strip therefore does not need to contribute to the ornamental value of the chandelier thus reducing manufacturing costs. Further, the strip (12) may be located in any desired orientation, for example, with the strip (12) fixed horizontally in the framework, the trimming (6) resting finally in a vertical position.

In the final position the hook can not be separated from the strip in a horizontal outward or vertical downward motion.

Figure 3A:
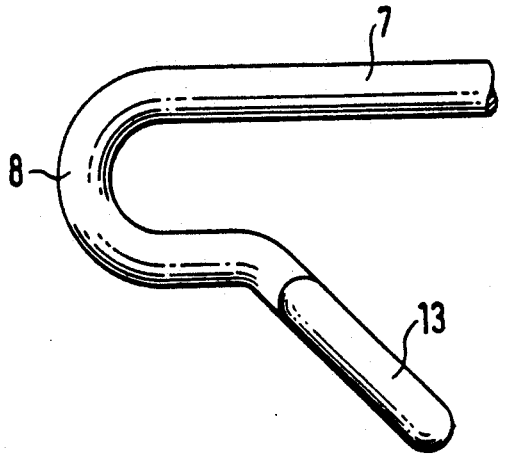
Figure 3B:
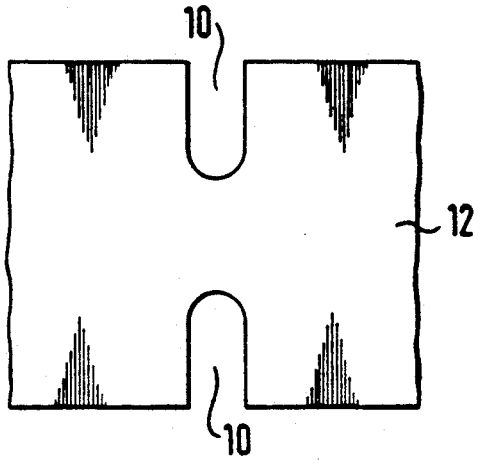
Figure 3C:
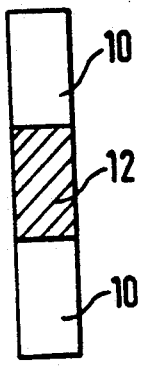
Figure 3D:
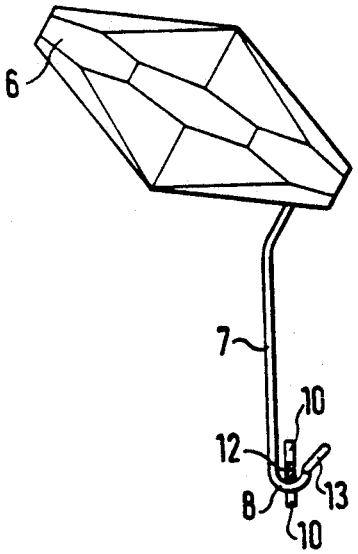
Figure 3E:
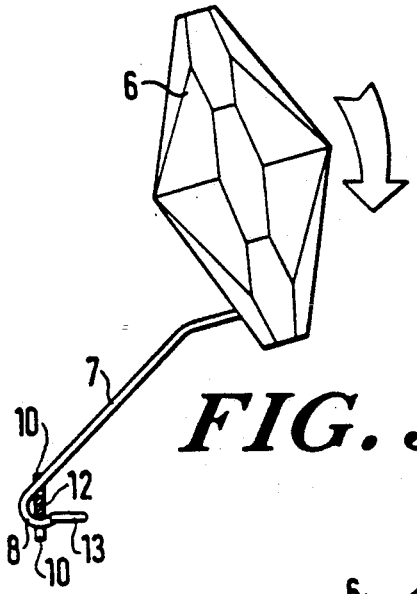
Figure 3F:
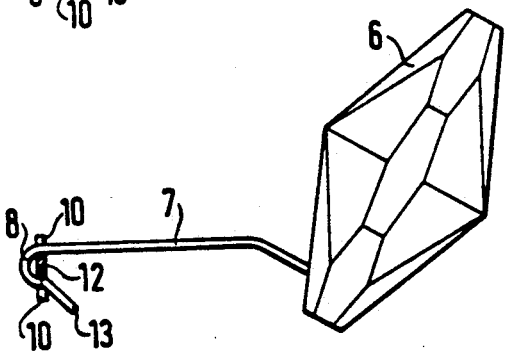
Figure 3G:
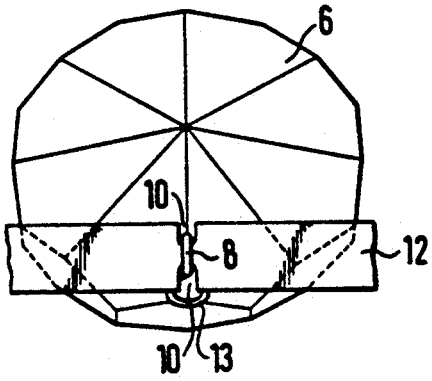

The second embodiment of the present invention is shown in FIGS. 3*a*–3*g*, this embodiment being basically similar to the first embodiment except that the end of the "U"-shaped bend (8) is terminated by a ring or loop (13), which can preferably be manufactured from a portion of the hook wire (7). The arrangement of the slots (10) in the strip (12) as shown in FIGS. 3*b* and 3*c* is identical to the framework of the first embodiment. In this case the loop or ring (13) is manufactured so that it is larger in diameter than the width of the slots (10).

The installation sequence of the chandelier fitting according to the second embodiment of the present invention is shown in FIGS. 3*d* to 3*g* and is basically equivalent to the method shown in FIGS. 2*d* to 2*g*.

In the final position the hook can not be separated from the strip in a horizontal outward or vertical downward motion.

The chandelier according to the first or second embodiment of the present invention has the advantage in comparison with conventional methods that the strip (12) can be made from a non-ornamental material and the attachment means for the hook of the fitting is produced as an integral part of the strip (12) and not a separate bracket welded or soldered to the frame. The manufacturing costs of the chandelier are therefore considerably reduced. The additional head (9) or the ring (13) at the end of the hook (7) can also be relatively easily manufactured during the production of the hook. Any suitable enlarged portion may be used as the stop at the end of the "U"-shaped bend (8).

Figure 4A:
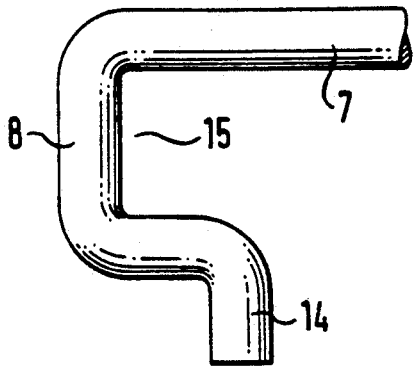
Figure 4B:
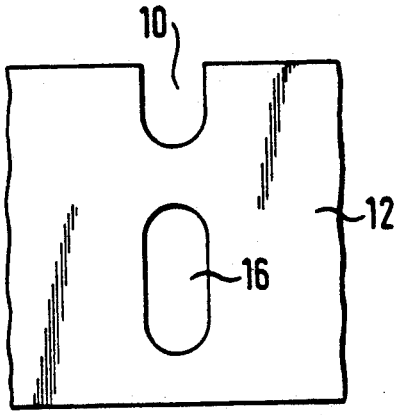
Figure 4C:
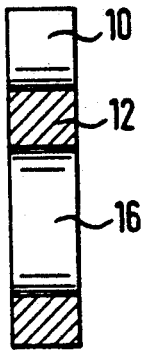

In some circumstances there is inadequate space to install the jewel when using fittings in accordance with the first or second embodiment of the present invention. In crowded or difficult locations the fitting according to the third embodiment of the present invention may be used as shown in FIGS. 4*a*–4*f*. The hook is basically formed from a "U"-shaped bend (8) as shown in FIG. 4*a* and can preferably be made so that the "U"-shaped bend is formed from two right angle bends and a straight portion therebetween, the inner surface (15) of the hook being flat. The end of the "U"-shaped bend (8) is further bent to form an end portion (14) which is preferably straight. The framework according to this embodiment is shown in FIGS. 4*b* and 4*c* and consists of a flat strip with an elongated closed slot (16) and an open slot (10), both slots being aligned substantially on the same axis. The elongated slot (16) is dimensioned so that the end portion (14) of the hook (7) will pass through.

Figure 4D:
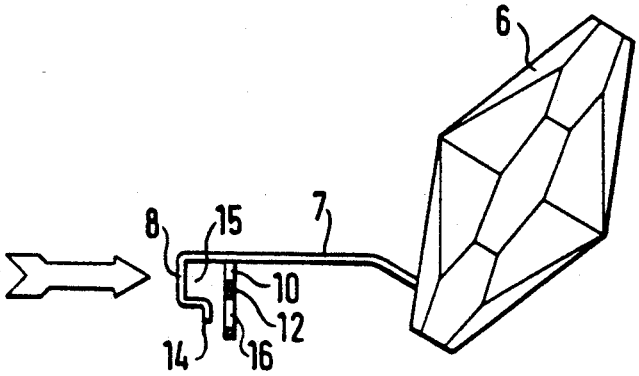
Figure 4E:
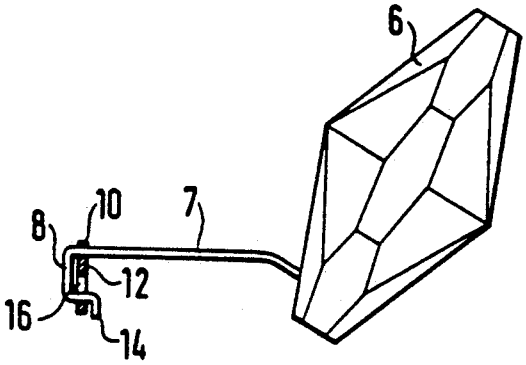
Figure 4F:
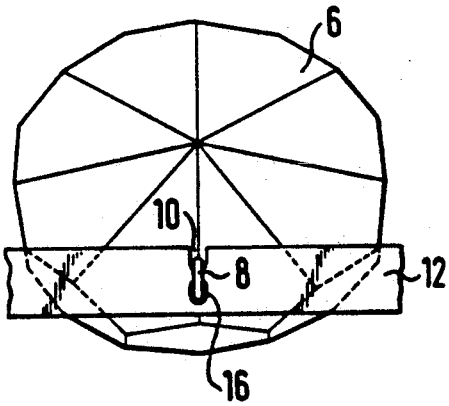

The installation of the fitting according to this embodiment is shown in FIGS. 4*d* to 4*f*. With reference to FIG. 4*d* the framework of the chandelier is manufactured, for example, with the strip (12) vertical, the open slot being above the closed slot. The trimming (6) and hook (7) are then offered up to the strip (12) such that the end portion (14) passes through the elongated slot (16). The fitting is then lowered as shown in FIG. 4*e* so that the end portion (14) rests behind the end of the strip (12) and the hook (7) lies in the slot (10). In this final position the hook can not be separated from the strip in a horizon- tal outward or vertical downward motion. The framework of the chandelier may of course be manufactured with the strip at any desired angle provided space allows the installation in the direction perpendicular to the strip (as shown by the arrow in FIG. 4*d*.

The dimensions of the "U"-shaped bend (8) shown in FIG. 4*a* should be so chosen that when the hook is in the final installed position as shown in FIG. 4*e* and the outer edge of the free arm of the "U"-shaped bend (8) lies against the end of the elongated slot the other arm of the "U"-shaped bend is located within the slot (10) and not above it.

This embodiment of the invention is particularly suitable for chandeliers which have to be hung close to the ceiling as the installation can be carried out with a simple horizontal movement with no rotational movement being required.

Figure 5A:
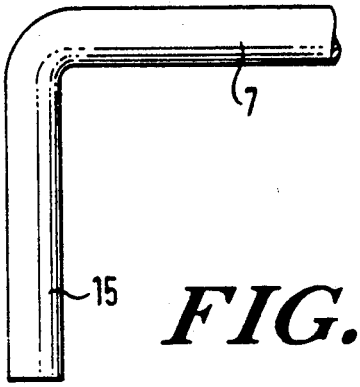
Figure 5B:
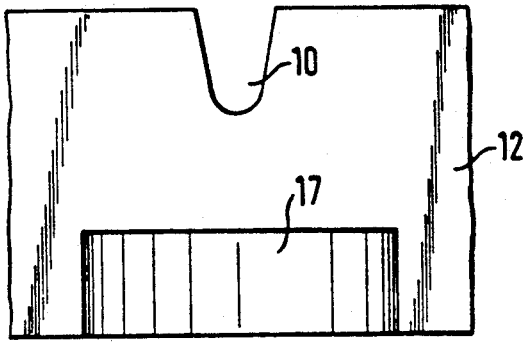
Figure 5C:
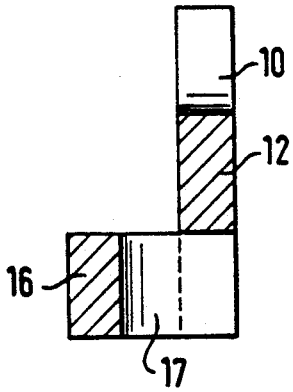
Figure 5D:
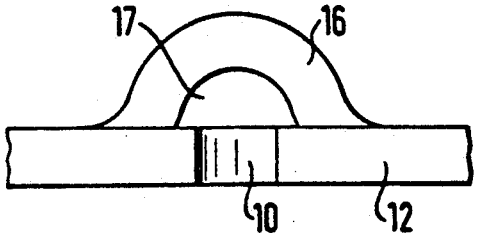

The fourth embodiment of the present invention is shown in FIGS. 5*a*–5*g*. In this embodiment the hook (7) of the chandelier fitting is provided with a single bend at its free end to form a straight portion (15). The framework of the chandelier is made from a strip (12) including a slot (10) located opposite a raised portion (16) of the strip (12) which forms a hole (17) which is aligned with the slot (10) as shown in FIGS. 5*b*, 5*c* and 5*d*. As in the previous embodiments the attachment means for the fitting is constructed as an integral part of the framework. As shown in the cross-sectional view of the framework in FIG. 5*c* the hole (17) is parallel but off-set to the slot (10).

Figure 5E:
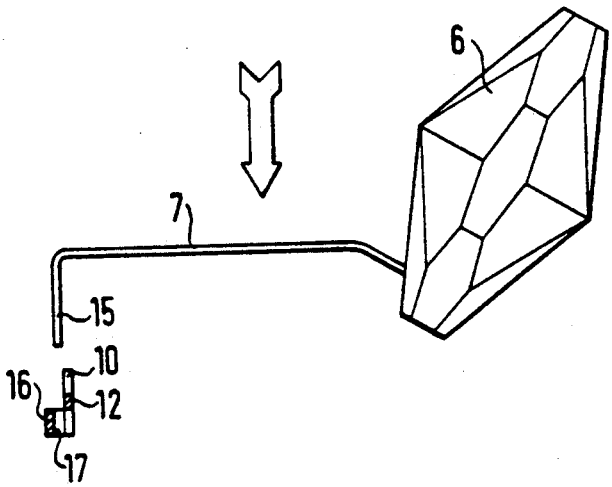
Figure 5F:
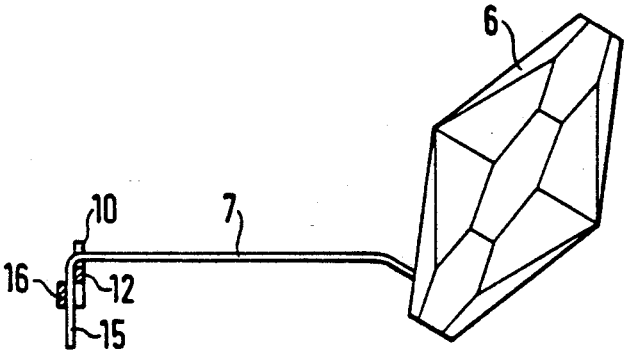
Figure 5G:
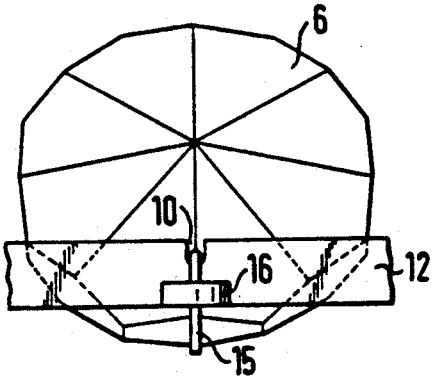

The installation procedure for this embodiment is shown in FIGS. 5*e* to 5*g*. The framework is assumed to be manufactured with the strip (12) being located in a vertical position with the hole (17) underneath the slot (10). The chandelier trimming is then arranged as shown in FIG. 5*e* so that the end (15) of the hook (7) points downwards towards the hole (17) of the strip (12). The trimming and the hook then are moved towards the strip with a vertical downward motion so that the end of the hook (15) locates in the hole (17) and the shank of the hook (7) rests in the slot (10) as shown in FIG. 5*f*. In this final position the hook can not be separated from the framework in a horizontal outward or vertical downward motion.

This embodiment of the invention is also suitable for chandeliers which have to be hung close to the ceiling.

Figure 6A:
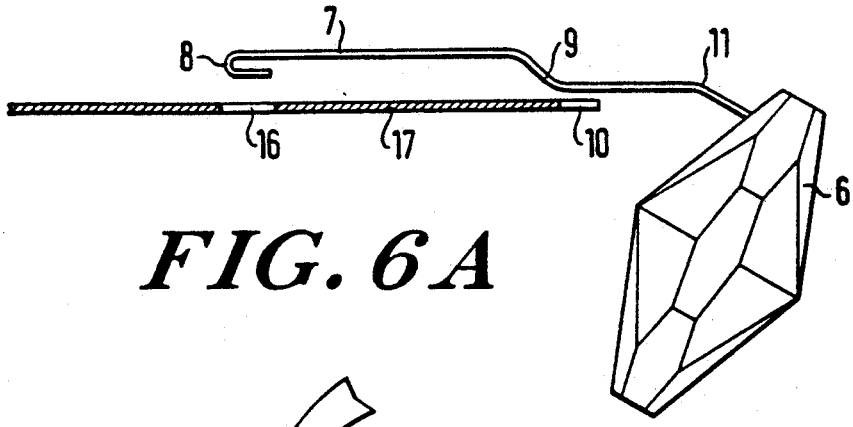
Figure 6B:
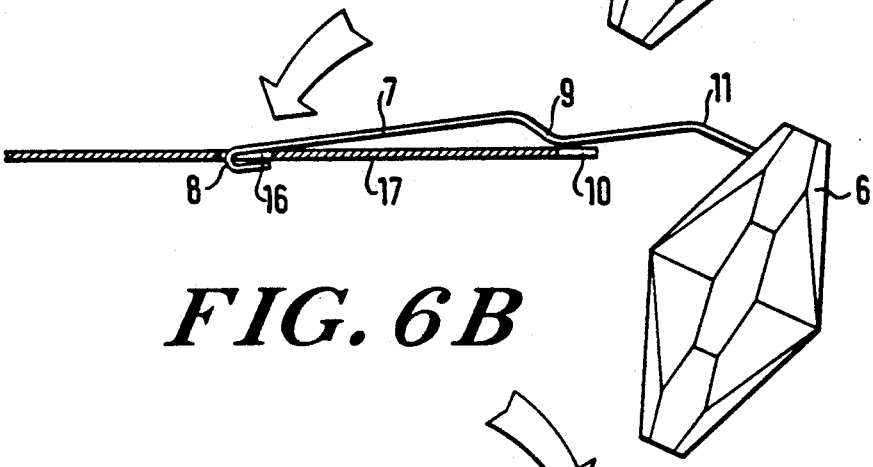
Figure 6C:
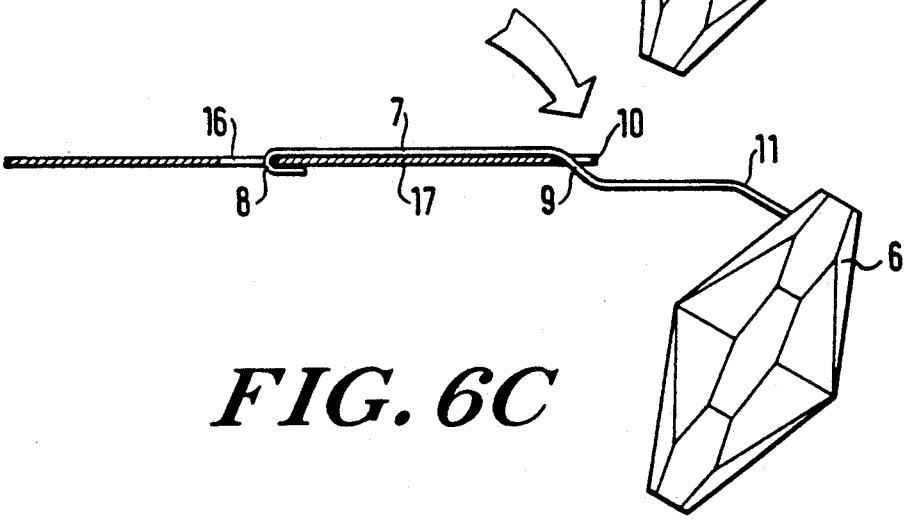
Figure 6D:
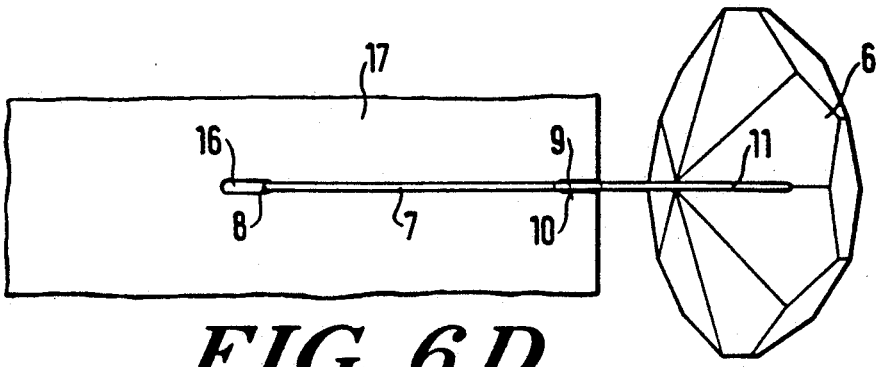

A further embodiment of the present invention is shown in FIGS. 6*a*–6*d*, this embodiment being particularly suitable when the framework of the chandelier is manufactured from a plate. For attaching the chandelier trimming the framework is provided with an elongated slot (16) and an open slot (10). The hook (7) is terminated by a "U"-shaped bend (8), and the shank of the hook (7) is bent to form a portion (9), the bend being in the direction of the "U"-shaped bend (8). As shown in FIG. 6*b* the chandelier trimming is inclined so that the "U"-shaped bend (8) can enter the slot (16) and the fitting (1) is then retracted and lowered so that the portion (9) of the shank of the hook (7) locates into the slot (10). The distance between the "U"-shaped bend (8) and the portion (9) is chosen so that the "U"-shaped bend (8) encompasses a portion of the framework (17) when the portion (9) is located in the slot (10). In this way the hook can not be removed from the plate in a horizontal outward or vertical downward motion when the trimming is in the final position. FIG. 6*d* shows the trimming in the final position as seen from above. This embodiment is particularly suitable for installing chandeliers in a "close-to-the-ceiling" position.

Figure 7A:
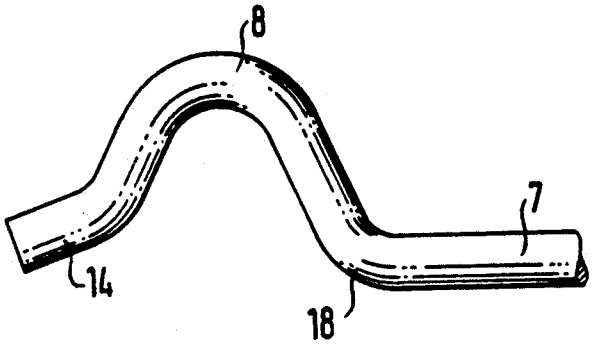
Figure 7B:
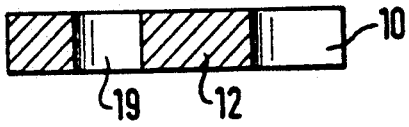
Figure 7C:
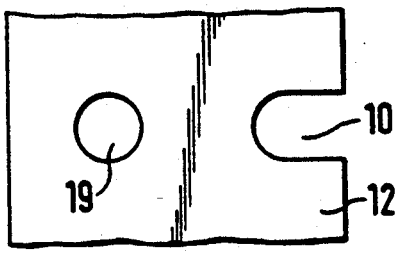

The sixth embodiment of the present invention is shown in FIGS. 7*a*–7*f* in which the hook (7) is terminated by a substantially "U"-shaped bend (8) including an end portion (14) bend in the opposite direction to the "U"-shaped bend. The end portion (14) is preferably straight. In order to permanently set the position of the jewel to obtain the correct position a further bend (18) is provided in the shank of the hook, this bend lying at the opposite end of the "U"-shaped bend from the end portion (14) as shown in FIG. 7*a*. The framework of the chandelier is preferably manufactured from a strip (12) and is provided with a hole (19) and a slot (10), the hole (19) being aligned with the open slot (10).

Figure 7D:
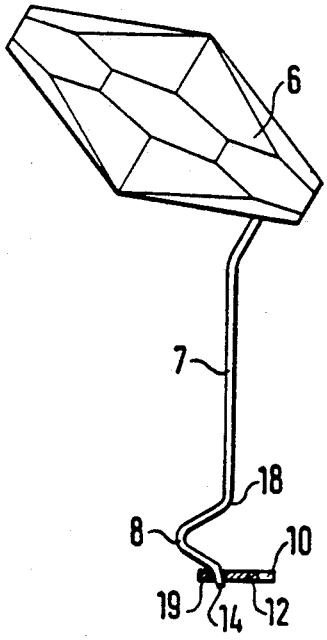
Figure 7E:
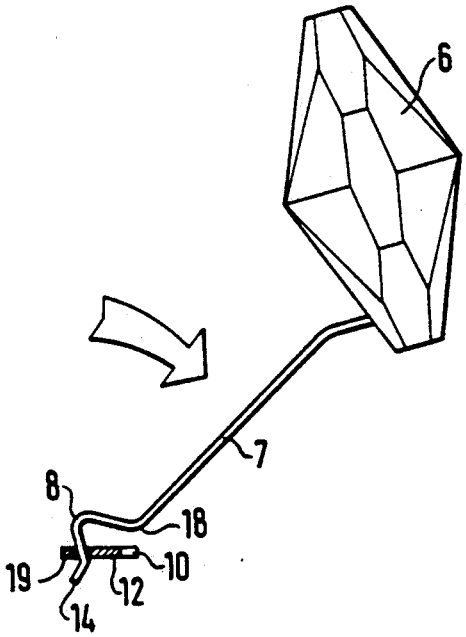
Figure 7F:
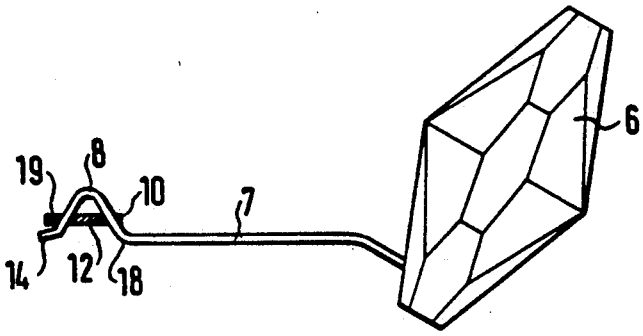

The installation procedure of this embodiment is shown in FIGS. 7*d* to 7*f*. The framework of the chandelier is preferably manufactured with the strip (12) lying horizontally as shown in FIG. 7*d*. The trimming (1) is then positioned vertically above the strip (12) so that the end portion (14) of the hook can be located in the hole (19). FIG. 7*e* shows an intermediate position in which the trimming has been rotated and lowered so that the end portion (14) of the hook (7) passes completely through the hole (19). FIG. 7*f* shows the final position of the trimming where the trimming (6) has been lowered so that it rests roughly in a horizontal position and the inside arm of the "U"-shaped bend (8) is located in the slot (10). The exact position of the trimming (6) is determined by the degree of bend of the bends (18) and (11). In the final position the hook can not be separated from the strip in a horizontal outward or vertical downward motion.

In all the embodiments of the present invention the hook (7) is preferably manufactured from a wire and the framework is preferably manufactured from a strip or plate. However, the scope of the present invention covers any form of hook or framework which is described by the claims.

I claim:

1. A Chandelier including chandelier trimmings connected with a hook means and a framework for carrying said hook means by an attachment means, characterized by said attachment means being two openings spaced apart by a first distance, one of the openings being a first open-ended slot, wherein the hook is free from contact with the framework outwardly of the slot.

2. A chandelier as claimed in claim 1, wherein the other of said openings is a hole having a width of a second distance.

3. A chandelier as claimed in claim 2 wherein the open portion of the slot is located at an end of the slot opposite the hole.

4. A chandelier as claimed in claim 2 wherein the hole is elongated and defines an axis in the direction of elongation, and wherein the slot lies on said axis.

5. A chandelier as claimed in claim 1, 3 or 4 wherein the hook means includes a bend for setting the position of a jewel in the chandelier.

6. A chandelier as claimed in claim 1, 3 or 4 wherein the hook means includes two spaced-apart bends for setting a jewel in the chandelier.

7. A chandelier as claimed in claim 6 wherein the hook means is formed from a wire and the attachment means lie substantially in one plane.

8. A chandelier as claimed in claim 1, 2, 3 or 4 wherein the hook means is formed from a wire and the attachment means lie substantially in one plane.

9. A chandelier as claimed in claim 2 or 3 wherein the hole defines a plane substantially perpendicular to a plane defined by the open-ended slot.

10. A chandelier as claimed in claim 9 wherein the hook means has a shank and a free end and wherein the hook means is formed at its free end with a substantially "L"-shaped bend.

11. A chandelier as claimed in claim 10 wherein the hole is integrally formed from a raised portion of the framework.

12. A chandelier as claimed in claim 2, 3 or 4 wherein the hook means is formed at its free end with a substantially "U"-shaped portion having two arms, the free end of the "U"-shaped portion being further bent in an opposite direction thereto to form an end portion.

13. A chandelier as claimed in claim 12 wherein the end portion is straight.

14. A chandelier as claimed in claim 12 wherein the "U"-shaped portion is formed from a double bend with a straight portion therebetween, on a side of the "U"-shaped portion facing the framework.

15. A chandelier as claimed in claim 12 wherein the arms of the "U"-shaped portion are separated by an amount which is larger than said first distance.

16. A chandelier as claimed in claim 12 wherein the arms of the "U"-shaped portion are separated by an amount which is at least substantially equal to said first distance and at a maximum equal to the sum of said first and second distances.

17. A chandelier as claimed in claim 12 wherein the hook means is formed from a wire and the attachment means lie substantially in one plane.

18. A chandelier as claimed in claim 2, 3, 4, or 5 wherein the hole is circular.

19. A chandelier as claimed in claim 18 wherein the hook means is formed at its free end with a substantially "U"-shaped portion, the free end of the "U"-shaped portion being further bent in an opposite direction thereto to form an end portion.

20. A chandelier as claimed in claim 19 wherein the end portion is straight.

21. A chandelier as claimed in claim 19 wherein the hook means is formed from a wire and the attachment means lie substantially in one plane.

22. A chandelier as claimed in claim 4 wherein the hole defines a plane and wherein the open-ended slot lies substantially in the plane.

23. A chandelier as claimed in claim 1 wherein the hook means has a shank and a free end, the hook means being formed at its free end with a substantially "U"-shaped bend having two arms, the arms thereof being substantially parallel in the installed position to the plane of the slots, and further being provided with a bend in the shank of the hook means in the same direction as the direction of the bend of the "U"-shaped portion.

24. A chandelier as claimed in claim 23 wherein the hole is elongated, the "U"-shaped bend is located in the elongated hole and the bend in the shank is located in the open slot and is spaced from said "U"-shaped portion by an amount substantially equal to said first distance.

25. A chandelier as claimed in claim 23 wherein the hook means is formed from a wire and the attachment means lie substantially in one plane.

26. A chandelier as claimed in claim 1, wherein the other of said openings is a second open-ended slot having a length of a second distance.

27. A chandelier as claimed in claim 26 wherein the hook means has a shank and a free end, the hook means being formed at its free end with a substantially "U"-shaped bend having two arms, the hook means further being provided with a stop means at its free end.

28. A chandelier as claimed in claim 27, wherein the stop means is a solid head having a diameter greater than a width of one of the slots.

29. A chandelier as claimed in claim 27, characterized in that the arms of the "U"-shaped bend are separated by an amount which is at least substantially equal to said first distance and at a maximum equal to the sum of said first and second distances.

30. A chandelier as claimed in claim 27 wherein the hook means is formed from a wire and wherein the attachment means lie substantially in one plane.

31. A chandelier as claimed in claim 27 wherein the stop means is selected from the group consisting of a loop and a ring.

32. A chandelier as claimed in claim 26, wherein the open-ended slots have open ends facing away from one another.

33. A chandelier as claimed in claim 26, wherein the second open-ended slot is elongated and defines an axis in the direction of elongation, and wherein the first open-ended slot lies on said axis.

34. A chandelier as claimed in claims 26, 32, or 33, wherein the hook means includes a bend for setting the position of a jewel in the chandelier.

35. A chandelier as claimed in claim 26, 32, or 33 wherein the hook means is formed from a wire and wherein the attachment means lie substantially in one plane.

* * * * *